United States Patent [19]

Huether

[11] Patent Number: 4,902,536

[45] Date of Patent: Feb. 20, 1990

[54] METHOD OF PRODUCING A PROTECTIVE LAYER ON A STRUCTURAL PART

[75] Inventor: Werner Huether, Karlsfeld, Fed. Rep. of Germany

[73] Assignee: MTU Motoren-und Turbinen-Union Munchen GmbH, Munchen, Sweden

[21] Appl. No.: 79,166

[22] Filed: Jul. 28, 1987

[30] Foreign Application Priority Data

Aug. 21, 1986 [DE] Fed. Rep. of Germany ..... 3628363

[51] Int. Cl.[4] ..... B05D 3/12; F26B 5/06; F26B 5/10

[52] U.S. Cl. ..... 427/350; 34/5; 427/190; 427/398.4

[58] Field of Search ..... 427/350, 398.4, 435, 427/189–192; 34/5, 92

[56] References Cited

U.S. PATENT DOCUMENTS 3,702,779 11/1972 Fadner et al. ..... 34/5 X
4,328,285 5/1982 Siemers et al. ..... 427/190 X

FOREIGN PATENT DOCUMENTS 95678 6/1983 Japan ..... 427/190

*Primary Examiner*—Michael R. Lusignan
*Attorney, Agent, or Firm*—Roberts, Spiecens & Cohen

[57] ABSTRACT

A method for the production of a protective layer on a structural part against thermal, chemical and/or mechanical stresses, particularly structural parts of complex shape such as turbine blades in which powder of a starting material for the layer is suspended in a suspension liquid and the suspension is held at a temperature just above the freezing point of the suspension. The structural part to be coated is maintained at a temperature below the freezing point of the dispersing liquid and is dipped into the suspension so that a layer of the powder present in the suspension freezes firmly on the part. The thickness of the layer is dependent on the temperature of the structural part and the length of time during which the structural part remains immersed on the suspension. The structural part now coated with the powder layer is subjected to freeze drying and is thereafter heated to a temperature above the freezing point of the suspension.

16 Claims, No Drawings

METHOD OF PRODUCING A PROTECTIVE LAYER ON A STRUCTURAL PART

FIELD OF THE INVENTION

The present invention relates to a method of producing protective layers on structural parts of complex shape, such as turbine blades, to confer resistance for these parts to thermal, chemical and/or mechanical stresses.

BACKGROUND

By conventional technology it is known to form one or more layers of materials on a structural part to produce properties at the surface of the structural part which are different from those of the part itself. Examples of such layers are heat-insulating layers to resist pitting and corrosion, anti-wear layers including tribological layers and scraping and run-in layers. Such layers are applied in practice, primarily, by thermal spray processes.

The disadvantage of the known processes is that in the case of structural parts of complex shape, a sufficiently uniform thickness of the layer can not be applied to the structural part except with great difficulties. In order to eliminate these difficulties, even only partially, considerable expense is necessary.

SUMMARY OF THE INVENTION

An object of the invention is to provide a method for producing a protective layer on a structural part which has already been subjected to a shaping operation, and particularly a part of complex shape, especially in which the layer is applied a uniform with/thickness without great expense.

The method of the invention comprises depositing one or more layers physically from an initial powder in a suspension onto a cooled structural part by dipping the structural part into a bath of the suspension and subjecting the part now provided with a dip coating to freeze-drying.

Practically any desired thickness of the protective layer can be produced uniformly and in an advantageous manner according to the invention and the individual steps of the method can be repeated as frequently as desired, such as, for instance, the production of the dip coating.

Depending on the desired purpose of the layer, after the production of the coating, a heat treatment and other subsequent treatments of the coated structural part can be carried out such as, for example, dense sintering or dense compression at the surface. In the case of special requirements, a sintering or compression operation can also be combined, for example, by hot isostatic compression. Treatments of the surface with energy beams, doping and infiltration of other substances as layer material and in a form other than powder can also be employed within the scope of the present invention. A binder, particularly an organic binder which produces increased green strength of the powder layer can advantageously be introduced into the suspension liquid, especially when the layer material is a under whose average particle size is greater than 25 μm. In such case, the organic binder is removed at the start of the sintering process or in a separate heat treatment.

The uses of the method of the invention are not limited to the given examples but are, in general, applicable to layer materials whose compositions are to provide properties different from the base material, i.e., the structural part to which the layers are applied. The invention is preferably employed for producing protective layers, particularly those subjected to multiple requirements. The main fields of use are, in general, machine construction, structural parts for vehicles of all kinds, but also stationary plants such as manufacturing plants, and, in particular, production apparatus. The base body of the composite member (said composite member being considered the end product of the invention) can be made of practically any desired material, such as metallic materials, metal compounds, intermetallic phases, ceramics, metal ceramics, metal, glass. glass ceramics, and/or combinations with plastics. As the protective layers, known substances or combinations of materials can be selected, depending on the resistance they are to provide. The percentages of the components for the starting materials or mixtures or suspensions which are given in the examples can be varied within wide limits within the scope of the aforementioned general physical principle of the method of the invention.

The apparatus necessary for carrying out the method of the invention is of simple and customary type, particularly the container necessary for the dipping process and the means for cooling the structural part, such as refrigerators. For the freeze-drying operation, conventional freeze-dryers used in the foodstuff industry can be employed, and similarly the annealing and sintering furnaces or presses or other after-treatment devices are of known type.

DETAILED DESCRIPTION

The invention will be described hereafter with reference to specific examples constituting representative embodiments of best modes thereof.

EXAMPLE 1

This example is directed to a method of producing a turbine rotor blade with a heat insulating layer thereon.

A suspension was prepared consisting of:

50 vol. % $H_2O$ (dispersing or suspension liquid)

50 vol. % $ZrO_2$ powder partially stabilized with 5% $Y_2O_3$.

The average particle size of the powder was 0.5 μm.

The suspension was maintained at a temperature of 5° C.

A structural part consisting of a rotor turbine blade was cooled to a temperature of −20° C. and fully immersed into the suspension for 10 seconds.

The structural part was removed from the suspension and freeze dried at a temperature of −10° C. under a vacuum of $10^{-2}$ mbar for two hours whereafter the part was then sintered at 1200° C. for 1 hour in a vacuum to produce a rotor blade with a heat insulating layer thereon of uniform thickness. The freeze drying can be carried out using propanol, especially isopropanol.

EXAMPLE 2

This example is directed to a method of producing turbine guide vanes with an anti-corrosion layer thereon.

A suspension was prepared consisting of 54.5 vol % $H_2O$ (dispersing or suspension liquid)

45.0 vol % CoCrAlY powder having an average particle size of 30 μm.

0.5 vol % polyvinyl alcohol (binder).

A structural part consisting of turbine guide vanes was cooled to −10° C. and the cooled part was fully immersed into the suspension for 5 seconds.

The part was removed from the suspension and freeze dried at a temperature of −10° C. under a vacuum of $10^{-2}$ mbar for four hours The part was then continuously heated from room temperature to 600° C. over 24 hours in a vacuum of not less than $10^{-2}$ mbar. During this heat treatment, the polyvinyl alcohol in the coating layer on the guide vanes was burned off.

The part was then sintered at 1150° C. for one-half an hour in a vacuum of not less than $10^{-2}$ mbar. The turbine guide vanes were formed with a uniform anti-corrosion layer thereon.

Although the invention has been described with reference to specific embodiments thereof, it will become apparent to those skilled in the art that numerous modifications and variations can be made within the scope and spirit of the invention as defined in the attached claims.

What is claimed is:

1. A method of producing a protective layer on a structural part comprising:

forming a suspension of a powder, which is to form a protective layer for a structural part, in a dispersing liquid, maintaining the suspension at a temperature above the freezing point of the dispersing liquid, maintaining the structural part to be coated at a temperature below the freezing point of the dispersing liquid, immersing the structural part into the suspension for a length of time so that a layer of the powder in the suspension freezes on the structural part, removing the thus coated structural part from the suspension and freeze drying the coating on the structural part.

2. A method as claimed in claim 1 comprising heating the structural part, after said freeze drying, to a temperature above the freezing point of the dispersing liquid.

3. A method as claimed in claim 2 wherein said powder is a metallic or ceramic powder having a maximum particle size of 50 μm.

4. A method as claimed in claim 2 wherein said powder is a metallic or ceramic powder having a maximum particle size of 25 μm.

5. A method as claimed in claim 1 wherein said suspension contains an organic expellable binder.

6. A method as claimed in claim 1 wherein said suspension is maintained at a temperature of between 0° and 20° C.

7. A method as claimed in claim 1 wherein said suspension is maintained at a temperature of between 0 and 20° C.

8. A method as claimed in claim 1 wherein said structural part is maintained at a temperature of about −20° C. and is immersed into the suspension for several seconds.

9. A method as claimed in claim 1 wherein said freeze drying is effected for several hours at a temperature of between about −10° C. and −30° C. under a vacuum pressure of up to $10^{-2}$ mbar.

10. A method as claimed in claim 1 comprising heat treating the coated part after freeze drying by gradually increasing the temperature of the coated part to about 600° C. in a vacuum.

11. A method as claimed in claim 10 comprising effecting a second stage of heat treating by sintering the part at a temperature of at least 1000° C. in a vacuum.

12. A method as claimed in claim 1 wherein said suspension contains a binder, the method further comprising removing the binder after the freeze drying by a heating step.

13. A method as claimed in claim 12 wherein said heating step comprises sintering the part.

14. A method as claimed in claim 1 wherein said freeze drying is effected by using propanol.

15. A method as claimed in claim 1 wherein said freeze drying is effected by using isopropanol.

16. A method as claimed in claim 1 wherein the dispersing liquid is water.

* * * * *